United States Patent [19]

Copie

[11] Patent Number: 4,759,659

[45] Date of Patent: Jul. 26, 1988

[54] VARIABLE VIBRATOR SYSTEM

[76] Inventor: Fernand Copie, 2650 Lee Ave. North, Minneapolis, Minn. 55422

[21] Appl. No.: 68,348

[22] Filed: Jul. 1, 1987

[51] Int. Cl.[4] ..... E01C 19/28

[52] U.S. Cl. ..... 404/117; 404/130; 74/87; 366/125

[58] Field of Search ..... 404/117, 130; 74/61, 74/87; 366/116, 125, 128; 209/366.5

[56] References Cited

U.S. PATENT DOCUMENTS

| | | | |
|---|---|---|---|
| 2,703,490 | 3/1955 | Brueggeman et al. | 74/61 X |
| 3,059,483 | 10/1962 | Clynch et al. | 366/125 X |
| 3,108,520 | 10/1963 | Garis et al. | 404/117 |
| 3,257,918 | 6/1966 | Garis et al. | 404/117 |
| 3,543,656 | 12/1970 | Roettger | 404/117 |
| 3,606,796 | 9/1971 | Pappers | 74/87 |
| 3,616,730 | 11/1971 | Boone et al. | 404/117 |
| 3,656,419 | 4/1972 | Boone | 404/117 |
| 3,722,381 | 3/1973 | Tuneblom | 404/117 |
| 3,813,950 | 6/1974 | Ebersole | 74/87 X |
| 3,814,532 | 6/1974 | Barrett et al. | 404/117 |
| 3,822,604 | 7/1974 | Grimmer | 366/128 X |
| 3,896,677 | 7/1975 | Larson | 74/61 |
| 3,909,147 | 9/1975 | Takata | 404/117 |
| 4,105,356 | 8/1978 | Loveless | 404/117 |
| 4,113,034 | 9/1978 | Carlson | 74/61 X |
| 4,313,691 | 2/1982 | Yargici | 404/117 |
| 4,342,523 | 8/1982 | Salani | 404/117 |
| 4,367,054 | 1/1983 | Salani et al. | 404/117 |
| 4,370,894 | 2/1983 | Sturesson | 404/117 X |
| 4,586,847 | 5/1986 | Stanton | 404/117 |

FOREIGN PATENT DOCUMENTS

| | | | |
|---|---|---|---|
| 464339 | 7/1975 | U.S.S.R. | 74/61 |
| 563274 | 6/1977 | U.S.S.R. | 366/128 |

OTHER PUBLICATIONS

Caterpillar, Inc., Brochure "CAT CS-551, CS-553, CP-553", Jan., 1987.

Caterpillar, Inc. Brochure "CAT DB-534", Jan., 1987.

*Primary Examiner*—Stephen J. Novosad

*Assistant Examiner*—John F. Letchford

*Attorney, Agent, or Firm*—Burd, Bartz & Gutenkauf

[57] ABSTRACT

A vibratory drum soil or asphalt compactor has a variable vibratory mechanism selectively operable to vary the vibrations imparted to the drum from a balanced mode to a maximum amplitude vibratory mode independently of the vibratory mechanism shaft rotation. A shaft having a shaft chamber for accommodating fluid is rotatably mounted on the drum. The shaft is equipped with a cylinder having a cylinder chamber connected with a passage to the shaft chamber. A piston closing the cylinder chamber and slidably mounted on the cylinder supports an eccentric weight. A control piston located with the shaft chamber operated by an external linear actuator is operable to move the piston away from the cylinder thereby move the weight into engagement with the shaft to balance the shaft and allow the weight to move away from the shaft to produce maximum vibration upon rotation of the shaft. The control piston is equipped with check valves operable to release excess fluid from the shaft chamber and add fluid to the shaft chamber to compensate for fluid volume variations due to thermal expansion and contraction.

34 Claims, 4 Drawing Sheets

FIG. 1
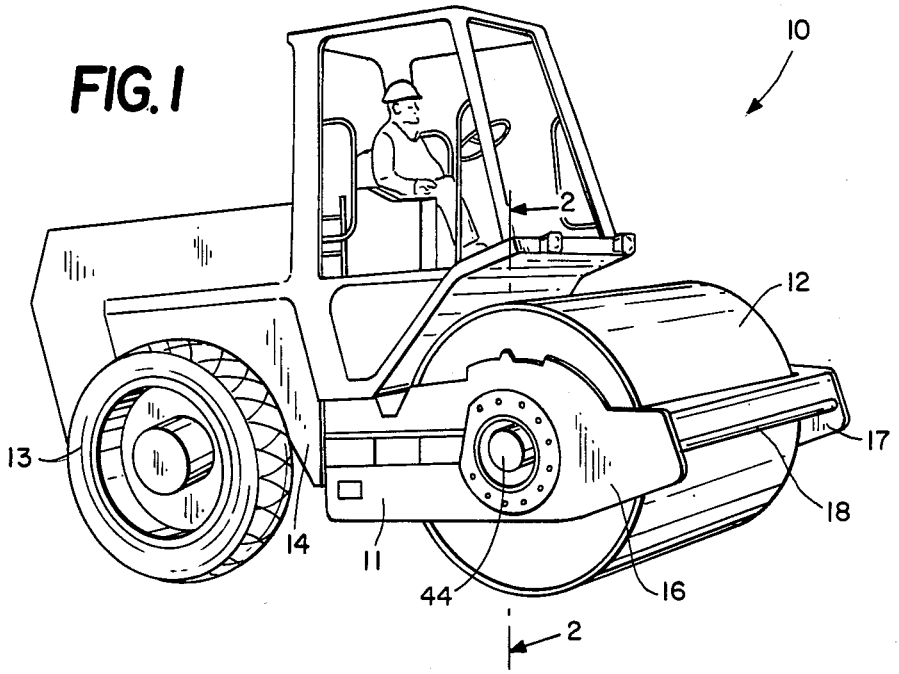
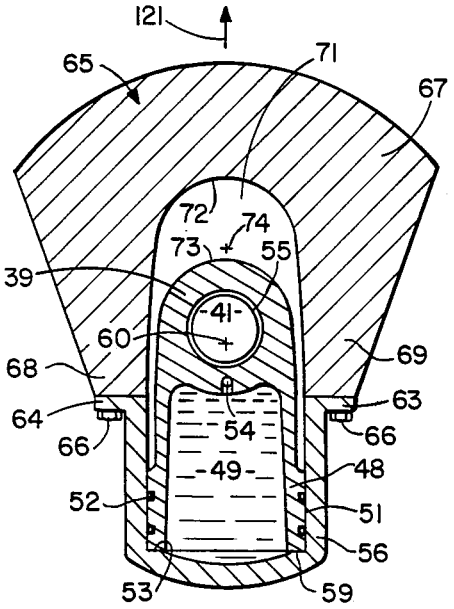
FIG. 3
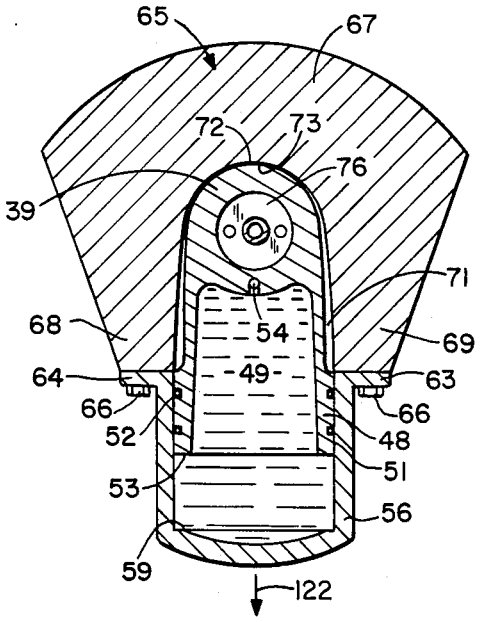
FIG. 6

VARIABLE VIBRATOR SYSTEM

FIELD OF THE INVENTION

The invention is in the field of vibration compacting machines utilizing rotational vibration mechanisms for changing the amplitude of the vibration imparted to a member. The vibratory mechanism is used in road and soil compacting machines having drums or screeds that are vibrated.

BACKGROUND OF INVENTION

Vibratory compactors having drums are used for compaction of soil, asphalt, and other ground surface materials. The compactor is a self-propelled vehicle having at least one drum equipped with one or more eccentric weights mounted on a power-driven shaft. The speed of rotation of the shaft is varied to obtain varying dynamic forces which impart vibrations to the drum. The frequency and amplitude of the vibrations imparted to the drum have been varied by providing a liquid weight to a resevoir rotated relative to the drum. The amount of liquid stored in the resevoir is used to vary the eccentric weight within the shaft. This vibratory system is disclosed by Boone in U.S. Pat. No. 3,656,419. A vibratory mechanism for a drum that does not have an external liquid resevoir is disclosed by Boone et al in U.S. Pat. No. 3,616,730. This vibratory mechanism has a pair of resevoirs connected on opposite sides of a power driven shaft. The fluid can flow between the resevoirs so as to selectively balance or vibrate the drum at a desired amplitude. Eccentric weights controlled by pistons to selectively produce either high or low amplitude vibration of a drum are disclosed by Barrett et al in U.S. Pat. No. 3,814, 532. An eccentric mass is movably mounted on a carrier for rotation about an axis parallel to the drum face. A releasable locking device, such as a hydraulic jack mounted on the carrier controls the position of the movable mass. A second eccentric mass fixed to the carrier is selectively counter-balanced by the movable mass thereby control the vibration amplitude imparted to the drum. A dual amplitude, rotational vibratory mechanism for a compaction drum in which the amplitude of the vibration can be changed by reversing the direction of rotation of the mechanism as disclosed by Stanton in U.S. Pat. No. 4,586,847. These vibratory mechanism are not variable between a balanced mode and a maximum vibration mode.

SUMMARY OF INVENTION

The invention concerns a vibratory mechanism for varying the vibrations subjected to a member from a balanced non-vibrating condition to selected maximum amplitude vibrations. The vibrations produced by the vibratory mechanism are independent of the direction of movement and the speed of the member. The vibrations generated by the mechanism when the member is rotating can be changed when the member is rotating as well as when it is stationary. The frequency and amplitude of the vibrations are independently variable by the operator. The mechanism has a rotatable shaft that supports a radially movable weight. A piston and cylinder assembly connected to the weight and the shaft is operable to move the weight into engagement with the shaft to balance the shaft and allow the weight to move away from the shaft to produce selected high amplitude vibrations of the member upon rotation of the shaft.

Fluid under pressure is supplied to the piston and cylinder assembly to move and retain the weight in engagement with the shaft. The weight naturally moves away from the shaft to its maximum position in response to centrifugal force subjected to the weight during rotation of the shaft. This causes maximum amplitude of the vibrations that are imparted to the shaft and member. The change in the vibrating characteristics of the vibratory mechanism can be made independent of the direction of the rotation of the shaft or the speed of rotation of the shaft. The amplitude of the vibrations is independent of the frequency of the vibrations.

In one embodiment of the invention, the vibratory mechanism is used with a drum of a soil compacting machine. The drum has end walls that rotatably carry a shaft located along the rotational axis of the drum. A motor, such as a hydraulic fluid operated motor, is connected to the shaft to rotate the shaft independent of the rotation of the drum. A weight comprising an eccentric mass is located adjacent the shaft for vibrating the shaft and drum in response to rotation of the shaft. The shaft includes a cylinder having a cylinder chamber closed with a piston connected to the weight. The piston is movable relative to the cylinder to move the position of the weight relative to the shaft. The shaft has a shaft chamber accommodating fluid that is in communication with the cylinder chamber. A control piston located in the shaft chamber is used to move the fluid from the shaft chamber to the cylinder chamber thereby move the piston and position the weight into engagement with the shaft to balance the shaft. When the force of an actuator on the control piston is released, the weight being subjected to centrifugal force, moves away from the shaft whereby upon rotation of the shaft high amplitude vibrations are imparted to the drum. The control piston has a first check valve that is operable to release fluid from the shaft chamber when the pressure of the fluid exceeds a predetermined value due to thermal expansion of the fluid. The first check valve allows the vibratory mechanism to be calibrated with the use of a selected fluid pressure in the shaft and cylinder chamber. The control piston has a second check valve operable to allow fluid to flow into the shaft chamber to compensate for reduction of volume of fluid in the shaft and cylinder chamber when the fluid is cooling of. An adjustment in the amplitude of the vibration of the drum is not dependent upon the direction of the rotation of the eccentric weight nor the direction of rotation of the drum. The change in the vibration amplitude is dependent upon the operation of the piston and cylinder assembly which repositions the eccentric weight relative to the axis of rotation of the shaft. The vibration amplitude is variable by the operator of the machine from a non-vibrating balanced mode to a maximum amplitude vibration mode independent of the rotation of the shaft and the speed of rotation of the shaft. The vibration mechanism is not subject to excessive wear and is rugged and durable in use.

DESCRIPTION OF DRAWING

FIG. 1 is a perspective view of a single drum vibratory soil compactor equipped with the vibratory mechanism of the invention;

FIG. 3 is a sectional view taken along the line 3—3 of FIG. 2;

FIG. 6 is an enlarged sectional view taken along the line 6—6 of FIG. 5.

DESCRIPTION OF PREFERRED EMBODIMENT

Figure 2:
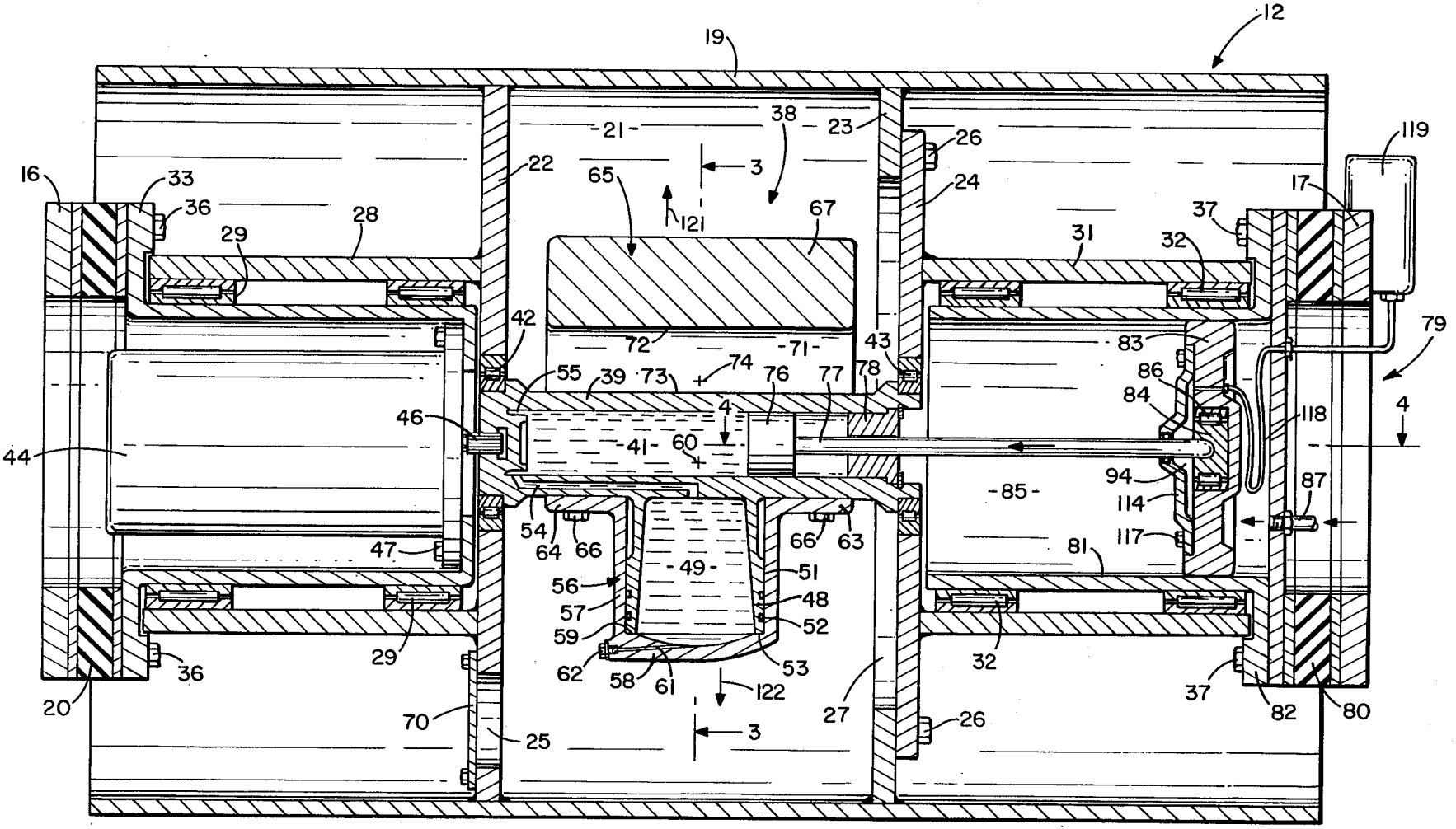
FIG. 2 is an enlarged sectional view taken along the line 2—2 of FIG. 1.

Referring to FIG. 1, there is shown a soil, asphalt, and ground surface material compactor machine known as a single drum vibratory compactor indicated generally at 10. Machine 10 has a front frame 11 rotatably supporting a transversely located drum 12. A pair of drive wheels 13 mounted on rear frame 14 are operable to move the machine over the soil. Frames 11 and 14 are pivotally connected with a vertical pin (not shown) and are articulately controlled with conventional hydraulic controls as described by Boone in U.S. Pat. No. 3,656,419. Rear wheels 13 are powered by a conventional internal combustion engine through a suitable drive train. Front frame 11 has a pair of forwardly directed side arms 16 and 17 extended adjacent opposite ends of drum 12. The forward ends of arms 16 and 17 are connected to a front cross beam 18 extended transversely across the front of drum 12.

As shown in FIG. 2, drum 12 has a continuous cylindrical wall or shell 19 surrounding an internal chamber 21. End walls 22 and 23 are secured to opposite end portions of wall 19. A large plate 14 secured with bolts 26 to end wall 23 closes an access opening 27 into chamber 21. Other openings 25 can be used to allow access into chamber 21.

Drum 12 is freely rotatably mounted on front frame 11 whereby cylindrical drum 12 rolls over the soil. A pair of sleeves 28 and 31 are secured to end wall 22 and plate 24 and surround bearings 29 and 32 respectively. Support 33 and cylinder 81 are secured with bolts 36 and 37 to side arms 16 and 17 through flexible rubber suspension members 20 and 80. Bearings 29 and 32 rotatably mount drum 12 on support 33 and cylinder 81. Other types of bearing supports and suspension members can be used to rotatably mount drum on arms 16 and 17. An example of suitable bearing and rubber suspension supports for the drum are shown by Larson in U.S. Pat. No. 3,896,677 and Yargici in U.S. Pat. No. 4,313,691. The vibratory mechanism of the invention can be used with each drum of a compactor having front and rear drums.

A selectively variable vibratory mechanism indicated generally at 38 located within drum chamber 21 is rotatably mounted on end wall 22 and end plate 24. Mechanism 38 has a transverse shaft 39 having a fluid accommodating shaft chamber 41. The fluid is a hydraulic noncompressible fluid, such a soil. A pair of bearings 42 and 43 rotatably mounted opposite end of shaft 39 on end wall 22 and end plate 24.

A reversible motor 44 is drivably connected with a drive splined shaft 46 to shaft 39 to selectively rotate shaft 39 in opposite directions. The end of shaft 39 has a splined bore to accommodate splined shaft 46. Motor 44 can be a hydraulic fluid operated motor or an electric motor. The controls for motor 44 are located in the operator cab for convenient use to control the speed and direction of rotation of shaft 39. This controls the frequency of the vibrations imparted to the drum. A plurality of bolts 47 secure motor 44 to support 33.

Shaft 39 has an outwardly directed radial cylinder 48 having a radial cavity or cylinder chamber 49. The outer wall of cylinder 48 has a cylindrical side wall 51 having annular grooves accommodating annular seals 52. The outer end of cylinder 48 has a flat annular surface 53 that functions as a stop determining the in or retracted position of a cup-shaped piston 56. Shaft 39 has a longitudinal passage 54 open to an annular groove 55 in the end of shaft chamber 41 and open to the bottom of chamber 49 whereby the oil can flow between chambers 41 and 49.

Piston 56 has a cylindrical side wall 57 slidably disposed on the cylindrical side wall 51 of cylinder 48 to close the outer open end of chamber 49. The seals 52 engage the cylindrical side wall 57 of piston 56 to avoid leakage of fluid from chamber 49. Side wall 57 is integral with an outer end wall 58 having an annular inside shoulder 59 adapted to engage annular end 53 of cylinder 48 to limit the inward movement of piston 56 relative to cylinder 48. Cylinder 48 and piston 56 has a center of gravity 60 located below the longitudinal rotational axis of shaft 39. Piston 56 has an air bleed passage 61 that leads to chamber 49. The outer end of passage 61 is closed with a threaded bolt 62. Air is bled from the chamber 41, passage 54, and chamber 49 through the air bleed passage 41. Piston 48 is rotated to an upright position so that air collects in the dome portion of piston 56 adjacent the inner end of passage 61. Plate 70 is removed from end wall 22 providing access to bolt 62. Bolt 62 is removed from piston 56 to allow air to flow out of chamber 49. Hydraulic fluid is introduced into chamber 41 to force all of the air from chamber 49. Bolt 62 is replaced in the outer end of passage 61 after all of the air is bled from passage 61. Plat 70 is then remounted on end wall 22.

Piston 56 has a pair of side flanges 63 and 64 secured with bolts 66 to a U-shaped weight 65 with a plurality of bolts 66. Weight 65 has a large heavy body or mass 67, preferably of metal, joined to a pair of laterally spaced legs 68 and 69. As shown in FIGS. 3 and 6, legs 68 and 69 are separated from each other and form a recess or groove 71 that straddles shaft 39. Groove 71 has a base 72 adapted to engage a linear sector 73 of the side of shaft 39 to limit the inward movement of body 67 relative to shaft 39. Shaft 39 is balanced when weight 65 is in the in position in contact with shaft 39 as shown in FIG. 6. Shaft 39 functions as a stop determining the in position of weight and balanced condition of shaft 39. Counterweight 65 has a center of gravity 74 laterally spaced from the axis of rotation of shaft 39 in a direction opposite the center of gravity 60 of the piston 67 and cylinder 48.

Control piston 76, shown in FIG. 2, slidably located in shaft chamber 41 operates to force the fluid in chamber 41 through passage 54 into chamber 49 thereby move piston 56 radially outward relative to cylinder 48. This moves the body 67 of weight 65 toward the axis of rotation of shaft 39. The eccentric moment of body 67 is reduced thereby reducing the amplitude of the vibrations imparted to drum 12. When body 67 engages shaft 39, as shown in FIG. 6, shaft 39 is balanced. Returning to FIG. 2, a piston rod 77 is connected and extends through a hole in a block 78 mounted on the end of shaft 39. A linear actuator, indicated generally at 79, mounted on side arm 17 through suspension member 80 with bolts 37 is operable to longitudinally move piston 76 in chamber 41. Linear actuator 79 comprises a piston and cylinder assembly having a cylinder 81 joined to a flange 82 that accommodates bolts 37. A piston assembly 83 is slidably located within control chamber 85 of cylinder 81. Piston assembly 83 has a central pad 84 that is rotatably connected to piston 83 with a bearing 86. Fluid, such as air or a liquid, oil or the like, under control pressure is carried via fluid line 87 into control chamber 85 of linear actuator 79 to move piston assembly 83 and thereby move control piston 76 into chamber 41. The fluid under pressure is supplied from a fluid pressure source, such as a pump to line 87. A control valve (not shown) operable by the machine operator controls the pressure of the fluid supplied to control chamber 85 thereby control the amount of movement of piston assembly 83. This controls the amplitude of the vibrations generated by the vibratory mechanism. Linear actuator 79 can be other types of mechanisms operable to move control piston 76 in system chamber 41. A ball circulating nut and screw actuator driven by a reversible motor and connected to control pad 84 by a bearing 86 can be used to move control pad 84 and hold control pad 84 in a selected position.

Figure 4:
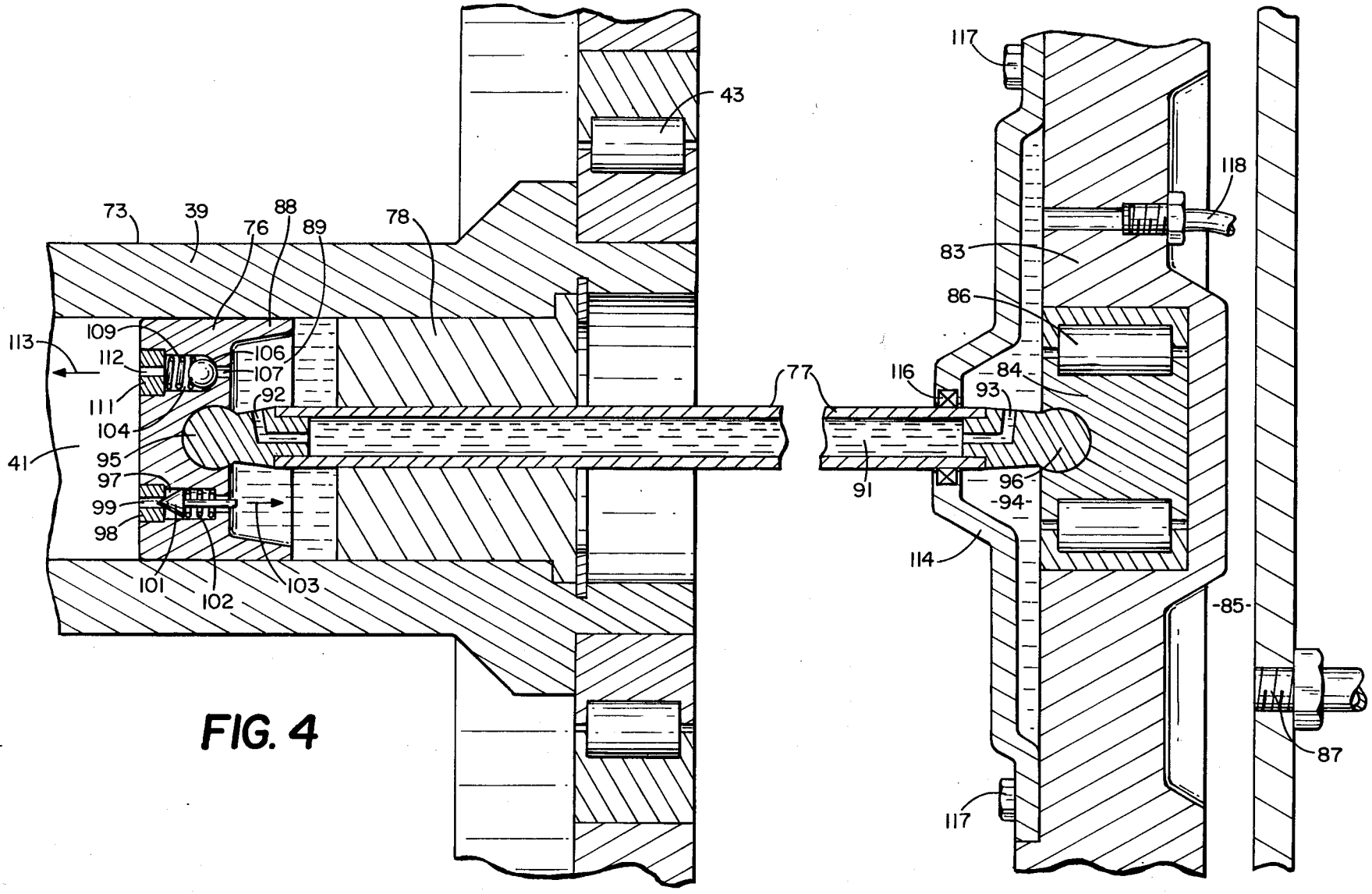
FIG. 4 is an enlarged foreshortened sectional view taken along the line 4—4 of FIG. 2.

Referring to FIG. 4, control piston 76 has a rearwardly directed annular flange 88 forming a pocket 89 for accummulating hydraulic fluid. Pocket 89 is open to a longitudinal passage 91 in piston rod 77. Passage 91 has a first end 92 open to pocket 89 and a second end open to a chamber 94 adjacent pad 84. Piston rod 77 has a first ball end 95 located in a hemispherical shaped recess in piston 76. Opposite end of piston rod 77 has a ball-shaped end 96 located in a hemispherical recess in the center of pad 84. The ball-shaped ends 95 and 96 allow oscillatory movements of pad 84 and piston 76 relative to piston rod 77 to compensate for deflexion and misalignment that could occur between cylinder 81 and shaft 39.

Piston 76 has a first passage 97 accommodating an annular seat 98 for a first check valve 101. Seat 98 has a hole 99 that is normally closed with check valve 101. A coil spring 102 biases check valve 101 to the closed position. When the pressure of the hydraulic fluid, i.e. oils, in chamber 41 exceeds a predetermined pressure check valve 101 moves away from seat 98 allowing the oil to flow from chamber 41 through passage 97 into chamber 89 as shown by arrow 103 until check valve 101 is biased by spring 102 to its closed position. The biasing force of spring 102 calibrates the maximum pressure of oil in chamber 41. Valve 101 allows for expulsion of excess of oil in chamber 41 due to oil thermal expansion when oil in chamber is warming up.

Piston 76 has a second passage 104 having a shoulder which forms a seat 106 for a ball check valve 108. A hole 107 extends through seat 106 to pocket 89. The ball check valve 108 is retained in the closed position with a spring 109 that engages ball 108 and an annular ring or plug 111 having a central hole 112. Plug 111 is mounted on piston 76 with hole 112 in alignment with passage 104. When the actuating oil in chamber 41 is cooling, the volume of the oil reduces thereby reducing the pressure of the oil in chamber 41. The oil under low charge pressure, i.e. 20–100 psi, in pocket 89 then moves ball check valve 108 to an open position allowing the oil to flow into chamber 41 as shown by arrow 113. The ball check valve 108 compensates for the loss of volume of the oil in chambers 41 and 49 due to cooling of the oil and allow oil to flow into chabmer 41 during bleeding of air from chamber 49.

Oil under low charge pressure is supplied to pocket 89 via passage 91 and piston rod 77 and chamber 94. A casing 114 surrounds piston rod 77. Seal 116 mounted on the casing 114 surrounds piston rod 77 which rotates about its longitudinal axis relative to casing 114. A plurality of bolts 117 secure casing 114 to piston 85. Oil under low charge pressure is supplied to chamber 94 via a flexible line 118 leading to a supply of oil under pressure such as an accummulator 119 or pump. Accummulator 119 is operable to maintain a constant supply of oil at a pressure of about 20 to 100 psi. Other types of oil pressure sources, such as a pump or oil pressure system of the machine, can be used to supply oil under low charge pressure to chamber 94.

Figure 5:
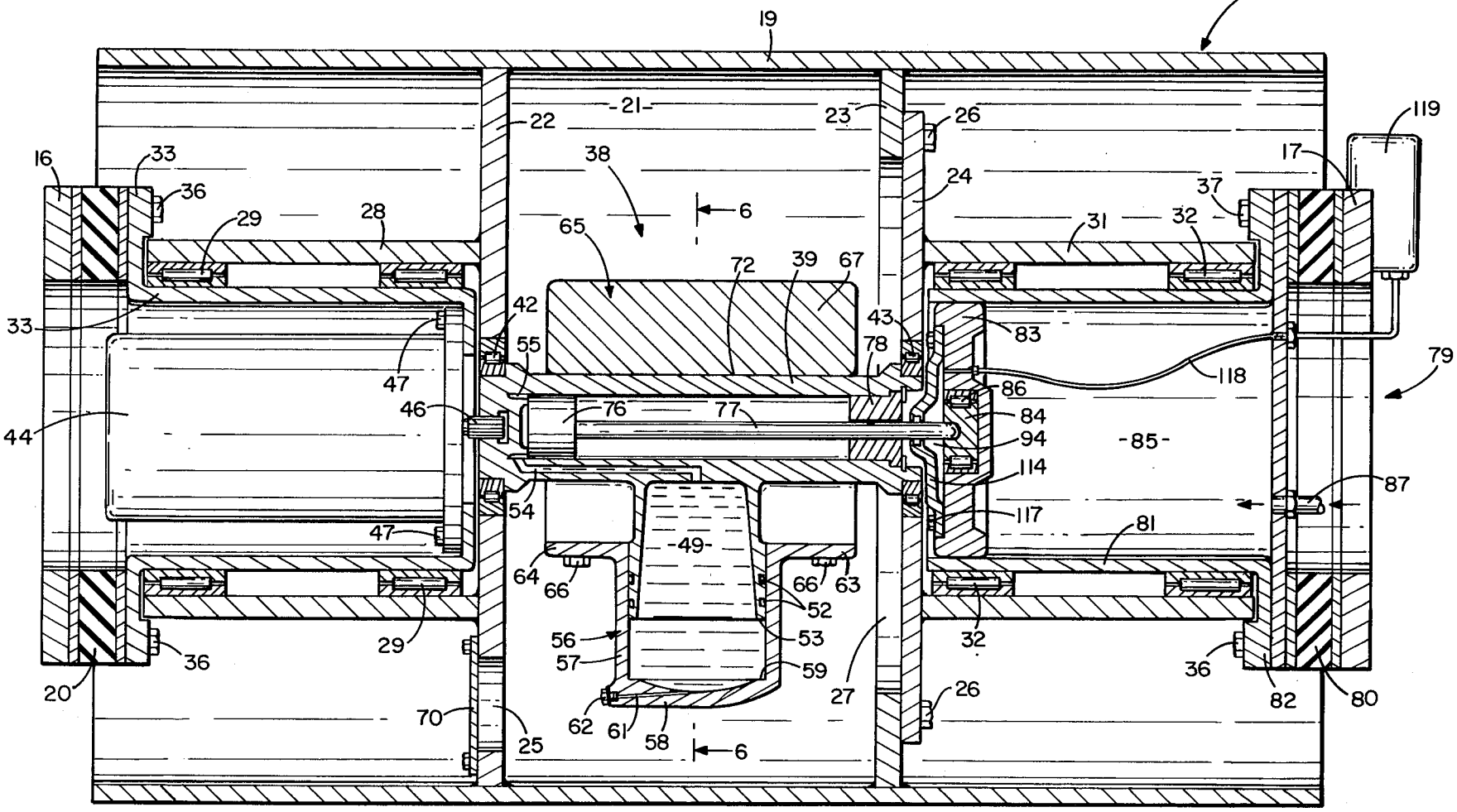
FIG. 5 is a sectional view similar to FIG. 2 showing the eccentric weight positioned in the balanced locations.

In use, when the machine 10 is not in operation, weight 65 is located in the balanced or in position in engagement with shaft 39, as shown in FIGS. 5 and 6. Linear actuator 79 being subjected to fluid under pressure holds control piston 76 in the in position to hydraulically lock piston 56 and cylinder 48 in the expanded position. The compaction of the soil or road material commences with movement of machine 10 at a travel speed of about 1 mph. Drum rolls over the soil. Shaft 39 is then rotated by operation of motor 44 in selected direction of rotation and a selected speed or RPM, such as 0 to 4000 RPM. The direction of rotation of shaft 39 can be clockwise or the same as the direction of rotation of drum 12 or counter clockwise or opposite the direction of rotation of drum 2. The speed of rotation is adjusted to provide the desired vibration frequency or vibrations per minute VPM, such as 2800 VPM. The frequency of the vibrations is determined by the rotational speed of shaft 39 driven by motor 44. The amplitude of the vibrations due to weight 65 in the eccentric or out position is independent of the direction or rotation of shaft 39 and drum 12 or the direction of movement of vehicle 10. The linear actuator 79 is operated to allow control piston 76 to move back away in chamber 41 from groove 55. This allows fluid to flow from chamber 49 into chamber 41 whereby weight 65 moves away from shaft 39 as indicated by arrow 121 in FIGS. 2 and 3. Weight 65 being located off center or in eccentric position generates vibrations that are imparted to drum 12. The radial position of weight 65 relative to shaft 39 determines the amplitude of the vibrations. The amplitude of the vibrations can be changed from a balanced or zero vibration to maximum vibrations independent of the speed of rotation or direction of rotation of shaft 39 and the travel speed or direction of movement of machine 10.

The operator of vehicle 10 can reduce the amplitude of the vibrations by applying fluid under pressure to linear actuator 79 and thereby move piston assembly 83 to an in position. This moves control piston 76 into shaft chamber 41. The oil in chamber 41 flows via passage 54 into cylinder chamber 49. The increase in the volume and pressure of the oil in chamber 49 when the pressure of fluid in chamber 49 has a force equal to the centrifugal force if weight 65 moves piston 56 in a radial outward direction as indicated by arrow 122 in FIGS. 2 and 6. Piston 56 will continue to move in an outward direction until weight 65 engages shaft 39. The center of gravity 74 of weight 65 moves toward the axis of rotation of shaft 39 thereby reducing its eccentric moment. The center of gravity of the piston 56 and cylinder 48 along with the fluid in the cylinder chamber 49 moves away or outwardly of the axis of rotation of shaft 39 and thereby the piston and cylinder balances weight 65. This balances shaft 39. When shaft 39 is balanced, there are no vibrations that are transferred to shaft 39 and drum 12. Weight 65 will remain in the balanced position as long as the pressure of the oil in cylinder chamber 49 is sufficient to hold weight 65 in engagement with shaft 39. The continued application of fluid, such as air or oil, under pressure in linear actuator 79 will maintain control piston 76 at the bottom of shaft chamber 41. The operator merely vents the fluid in the linear actuator 79 to allow weight 65 to move to its out position. The pressure of fluid in chambers 41 and 49 along with the centrifugal force of weight 65 will force the linear actuator back to its out position shown in FIG. 2. This movement will continue until piston shoulder 59 engages stop surface 53 of cylinder 48 as shown in FIG. 2 and 3. Supplying control chamber 85 with fluid under pressure can stop piston assembly 83 in any intermediate position thereby controlling the ampitude of the vibrations imparted to drum 12.

Referring to FIG. 4, when the system pressure of the fluid in shaft chamber 41 exceeds a predetermined maximum level, check valve 101 will more to the open position. The excess fluid will vent through the passage 97 into the pocket 89 as indicated by arrow 103. When the pressure of the fluid in the shaft chamber 41 falls below a selected value, the fluid under pressure in pocket 89 will open check valve 108 so that additional fluid can be supplied to shaft chamber 41 as indicated by arrow 113. The fluid is supplied to the pocket 89 via the passage 91 in piston rod 77 and chamber 94 in the actuator 79. The accumulator 119 continuously supplies fluid under pressure to the chamber 94 so that the proper amount of fluid is continuously made available for shaft chamber 41 and cylinder chamber 49.

While there has been shown and described preferred embodiment of the variable vibratory system of the invention as applied to a drum of a soil compactor, it is understood that the vibratory mechanism can be used with other machines that utilize variable vibratory conditions such as paver screeds. The vibratory mechanism can be used in soil compactors having two drums that rotatably support the machine on the soil, asphalt, or road materials to be compacted. The invention is defined in the following claims.

What is claimed is:

1. A vibratory mechanism for vibrating a member comprising: a shaft having a longitudinal axis, means for rotatably mounting the shaft on the member for rotation about the longitudinal axis thereof, means for rotating the shaft, weight means located adjacent said shaft for vibrating said member during rotation of said shaft, first piston means and first cylinder means connected to said shaft and said weight means operable to move said weight means into engagement with said shaft to balance said shaft and allow the weight means to move away from said shaft to produce high amplitude vibration of the member upon rotation of the shaft, and means for supplying fluid under pressure to said first piston means and first cylinder means whereby the weight means is moved by the first piston means and first cylinder means into engagement with the shaft to balance said shaft thereby avoiding vibration of the member, said means for supplying fluid under pressure to said first piston means and first cylinder means being operable to allow fluid to flow from the first piston means and first cylinder means whereby the weight means moves away from the shaft causing vibration of the member upon rotation of the shaft.

2. The mechanism of claim 1 wherein: the weight means has a body and legs laterally spaced from each other providing a groove accommodating said shaft, said first piston means and first cylinder means having a cylinder with a cylinder chamber for accommodating a fluid and a piston slidably mounted on the cylinder having an end exposed to said cylinder chamber, and means connecting the piston to said legs whereby movement of the piston moves the body relative to said shaft.

3. The mechanism of claim 2 wherein: said cylinder is connected to the shaft and said piston being movably mounted on the cylinder.

4. The mechanism of claim 2 wherein: said body has a portion located between said legs adapted to engage said shaft to limit movement of the piston and locate the body adjacent the shaft to balance said shaft.

5. The mechanism of claim 4 wherein: said piston and cylinder having cooperating stop means to limit movement of the weight means away from the shaft to provide maximum amplitude vibration of the member.

6. The mechanism of claim 5 wherein: said means for supplying fluid under pressure to said cylinder chamber includes an elongated second chamber within said shaft for accommodating fluid, said second chamber extended along the longitudinal axis of the shaft, passage means connecting the second chamber with the cylinder chamber to allow fluid to flow between the said chambers, second piston means movably located in said second chamber, and actuator means for moving said second piston means to alter the volume of said second chamber and operate the piston to move the weight means toward the shaft and retain the weight means in engagement with the shaft and allow the weight means to move away from the shaft.

7. The mechanism of claim 6 including: first check valve means mounted on said second piston means operable to vent fluid from said second chamber when the pressure of the fluid in said second chamber exceeds a selected value, and second check valve means mounted on said second piston means operable to allow fluid to flow into said second chamber when the pressure of the fluid in said second chamber falls below a selected value, and means to supply fluid under pressure to said second piston means to open said second check valve means and force fluid into said second chamber.

8. The mechanism of claim 6 wherein: the actuator means includes a third cylinder means and a piston assembly associated with the third cylinder means, and a piston rod extended between the second piston means and the piston assembly whereby movement of the piston assembly moves the second piston means in said elongated chamber.

9. The mechanism of claim 8 wherein: said second piston means has a pocket open to the first and second check valve means, said piston rod extended into said pocket, said means to supply fluid under pressure to said second piston means including a passage in said piston rod to carry fluid to said pocket.

10. The mechanism of claim 9 including: casing means secured to the piston assembly having a fluid supply chamber open to the passage in the piston rod, and means for supplying fluid under pressure to said fluid supply chamber.

11. The mechanism of claim 10 wherein: said piston assembly has a body and a pad rotatably mounted on the body, said piston rod being engageable with said pad.

12. The mechanism of claim 1 wherein: said means for supplying fluid under pressure to the first piston means and first cylinder means includes an elongated chamber within said shaft for accommodating fluid, said chamber extended along the longitudinal axis of the shaft, passage means connecting the chamber with the first piston means and first cylinder means, second piston means movably located in said elongated chamber, and actuator means for moving said second piston means to alter the volume of said elongated chamber and operate the first piston means and first cylinder means to move the weight means toward the shaft and allow the weight means to move away from the shaft.

13. The mechanism of claim 12 including: first check valve means mounted on said second piston means operable to vent fluid from said chamber when the pressure of the fluid in said chamber exceeds a selected value, and second check valve means mounted on said second piston means operable to allow fluid to flow into said chamber when the pressure of the fluid in said chamber falls below a selected value, and means to supply fluid under pressure to said second piston means to open said second check valve means and force fluid into said chamber.

14. The mechanism of claim 12 wherein: the actuator means includes a third cylinder means and a piston assembly associated with the third cylinder means, and a piston rod extended between the second piston means and the piston assembly whereby movement of the piston assembly moves the second piston means in said elongated chamber.

15. The mechanism of claim 14 wherein: said second piston means has a pocket open to the first and second check valve means, said piston rod extended into said pocket, said means to supply fluid under pressure to said second piston means including a passage in said piston rod to carry fluid to said pocket.

16. The mechanism of claim 15 including: casing means secured to the piston assembly having a fluid supply chamber open to the passage in the piston rod, and means for supplying fluid under pressure to said fluid supply chamber.

17. The mechanism of claim 16 wherein: said piston assembly has a body and a pad rotatably mounted on the body, said piston rod being engageable with said pad.

18. The mechanism of claim 1 wherein: said first piston means and cylinder means has a cylinder connected to said shaft and a piston slidably mounted on said cylinder responsive to fluid under pressure between said cylinder and piston to move the weight means away from said shaft, said piston and cylinder having cooperating stop means to limit movement of the weight means away from the shaft.

19. A drum and vibratory mechanism for a soil compacting machine comprising: a generally cylindrical shell having opposite ends, end wall means secured to said opposite ends of the shell, a shaft located within said shell between said end wall means and extended along the longitudinal rotational axis of the shell, means rotatably mounting the shaft on said end wall means, drive means operable to rotate the shaft in at least one direction about the longitudinal axis thereof, weight means adjacent said shaft for vibrating said shell during rotation of said shaft, first piston means and first cylinder means connected to said shaft and said weight means operable to move said weight means into engagement with said shaft to balance said shaft and allow the weight means to move away from said shaft to produce high amplitude vibration of said shell upon rotation of the shaft, and means for supplying fluid under pressure to said first piston means and first cylinder means whereby the weight means is moved by the first piston means and first cylinder means into and retained in engagement with the shaft to balance said shaft and thereby minimize vibration of said shell, said means for supplying fluid under pressure to said first piston means and first cylinder means being operable to allow fluid to flow from the first piston means and first cylinder means whereby the weight means moves away from the shaft causing vibration of the shell upon rotation of the shaft.

20. The drum and vibratory mechanism of claim 19 wherein the weight means has a body and legs laterally spaced from each other providing a groove accommodating said shaft, said first piston means and first cylinder means having a cylinder with a cylinder chamber for accommodating fluid and a piston slidably mounted on the cylinder having an end exposed to said cylinder chamber, and means connecting the piston to said legs whereby movement of the piston moves the body relative to said shaft.

21. The drum and vibratory mechanism of claim 20 wherein: said cylinder is connected to the shaft and said piston being movably mounted on the cylinder.

22. The drum and vibratory mechanism of claim 20 wherein: said body has a portion located between said legs adapted to engage said shaft to limit movement of the piston and locate the body adjacent the shaft to balance said shaft.

23. The drum and vibratory mechanism of claim 22 wherein: said piston and cylinder have cooperating stop means to limit movement of the weight means away from the shaft to provide maximum amplitude vibration of the shell.

24. The drum and vibratory mechanism of claim 23 wherein: said means for supplying fluid under pressure to said cylinder chamber includes an elongated second chamber within said shaft for accommodating fluid, said second chamber extended along the longitudinal axis of the shaft, passage means connecting the second chamber with the cylinder chamber to allow fluid to flow between the said chambers, second piston means movably located in said second chamber, and actuator means for moving said second piston means to alter the volume of said second chamber and operate the piston to move the weight means toward the shaft and retain the weight means in engagement with the shaft and allow the weight means to move away from the shaft.

25. The mechanism of claim 24 including: first check valve means mounted on said second piston means operable to vent fluid from said second chamber when the pressure of the fluid in said second chamber exceeds a selected value, and second check valve means mounted on said second piston means operable to allow fluid to flow into said second chamber when the pressure of the fluid in said second chamber falls below a selected value, and means to supply fluid under pressure to said second piston means to open said second check valve means and force fluid into said second chamber.

26. The drum and vibratory mechanism of claim 24 wherein: the actuator means includes a third cylinder means and a piston assembly associated with the third cylinder means, and a piston rod extended between the second piston means and the piston assembly whereby movement of the piston assembly moves the second piston means in said elongated chamber.

27. The drum and vibratory mechanism of claim 26 wherein: said second piston means has a pocket open to the first and second check valve means, said piston rod extended into said pocket, said means to supply fluid under pressure to said second piston means including a passage in said piston rod to carry fluid to said pocket.

28. The drum and vibratory mechanism of claim 27 including: casing means secured to the piston assembly having a fluid supply chamber open to the passage in the piston rod, and means for supplying fluid under pressure to said fluid supply chamber.

29. The drum and vibratory mechanism of claim 19 wherein: said means for supplying fluid under pressure to the first piston means and first cylinder means includes an elongated chamber within said shaft for accommodating fluid, said chamber extended along the longitudinal axis of the shaft, passage means connecting the chamber with the first piston means and first cylinder means to allow fluid to flow between the chamber and first piston means and first cylinder means, second piston means movably located in said chamber, and actuator means for moving said second piston means to alter the volume of said chamber and operate the first piston means and first cylinder means to move the weight means toward the shaft and to allow the weight to move away from the shaft.

30. The drum and vibratory mechanism of claim 29 including: first check valve means mounted on said second piston means operable to vent fluid from said chamber when the pressure of the fluid in said chamber exceeds a selected value, and second check valve means mounted on said second piston means operable to allow fluid to flow into said chamber when the pressure of the fluid in said chamber falls below a selected value, and means to supply fluid under pressure to said second piston means to open said second check valve means and force fluid into said chamber.

31. The drum and vibratory mechanism of claim 29 wherein: the actuator means includes a third cylinder means and a piston assembly associated with the third cylinder means, and a piston rod extended between the second piston means and the piston assembly whereby movement of the piston assembly moves the second piston means in said elongated chamber.

32. The drum and vibratory mechanism of claim 31 wherein: said second piston means has a pocket open to the first and second check valve means, said piston rod extended into said pocket, said means to supply fluid under pressure to said second piston means including a passage in said piston rod to carry fluid to said pocket.

33. The drum and vibratory mechanism of claim 32 including: casing means secured to the piston assembly having a fluid supply chamber open to the passage in the piston rod, and means for supplying fluid under pressure to said fluid supply chamber.

34. The drum and vibratory mechanism of claim 19 wherein: said first piston means and first cylinder means has a cylinder connected to said shaft and a piston slidably mounted on said cylinder responsive to fluid under pressure between said cylinder and piston to move the weight means away from said shaft, said piston and cylinder having cooperating stop means to limit movement of the weight means away from the shaft.

* * * * *